United States Patent [19]

Pallavicini

[11] 4,162,113

[45] Jul. 24, 1979

[54] COMPOSITE MODULAR FURNITURE

[76] Inventor: Piero Pallavicini, Via Fabio Filzi, 23, Milano, Italy

[21] Appl. No.: 852,555

[22] Filed: Nov. 17, 1977

[30] Foreign Application Priority Data

May 9, 1977 [IT] Italy ..... 23337 A/77

[51] Int. Cl.[2] ..... A47B 53/00; F16B 12/00

[52] U.S. Cl. ..... 312/199; 312/111

[58] Field of Search ..... 312/199, 198, 111; 52/33

[56] References Cited

U.S. PATENT DOCUMENTS

| | | | |
|---|---|---|---|
| 3,063,768 | 11/1962 | Moore, Jr. | 312/111 |
| 3,265,935 | 8/1966 | Rosa | 312/111 |
| 3,302,799 | 2/1967 | Blodee | 312/111 |
| 3,353,888 | 11/1967 | Pritelli, Jr. | 312/111 |
| 3,368,856 | 2/1968 | Tisdall et al. | 312/111 |
| 3,751,127 | 8/1973 | Black, Jr. et al. | 312/111 |
| 3,765,740 | 10/1973 | Mastrangelo | 312/111 |
| 3,841,725 | 10/1974 | Dorner | 312/111 |
| 3,841,726 | 10/1974 | Andros et al. | 312/111 |
| 4,055,373 | 10/1977 | Andresen et al. | 312/198 |

FOREIGN PATENT DOCUMENTS

| | | | |
|---|---|---|---|
| 92181 | 2/1962 | Denmark | 312/111 |
| 1015580 | 1/1966 | United Kingdom | 312/111 |
| 1281521 | 7/1972 | United Kingdom | 312/199 |

*Primary Examiner*—Victor N. Sakran
*Attorney, Agent, or Firm*—Karl F. Ross

[57] ABSTRACT

A modular piece of furniture such as a room divider, with a compartmented skeletal structure forming shelves and cabinets, has its horizontal and vertical wall members interconnected by moldings extending along orthogonally adjoining edges thereof with ribs fitting into longitudinal grooves of these edges. Other profiles, of generally trapezoidal cross-section, have exposed longitudinal slots accommodating inserts which carry hinge elements for the connection of swing doors to certain of these wall members. Similar profiles along the free edges of door leaves are fitted with bumper or sealing strips.

6 Claims, 19 Drawing Figures

5
3
8
7
8
3
4
5
9
6
7
6
12
9
11
8
12
6
3
11
6
7
4
12
4
4
11
0
10
4

Fig. 4
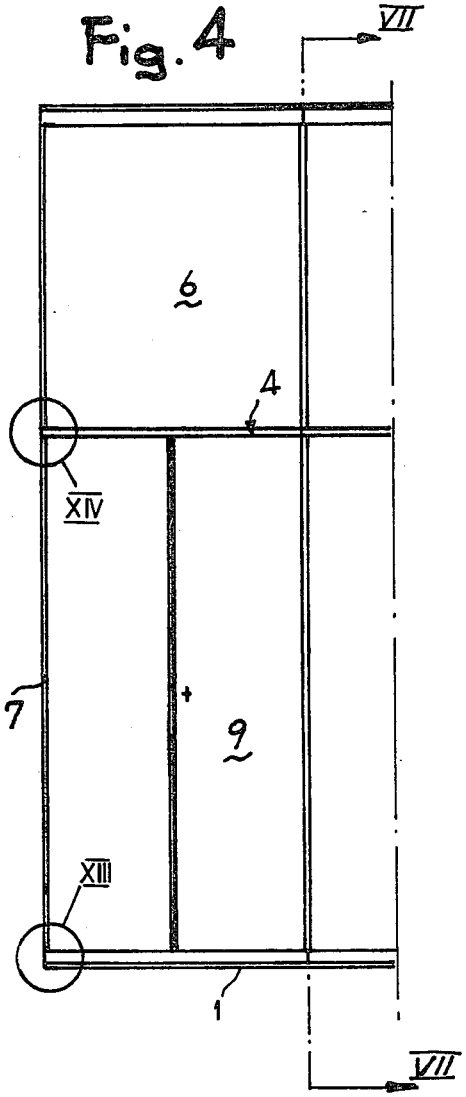
Fig. 6
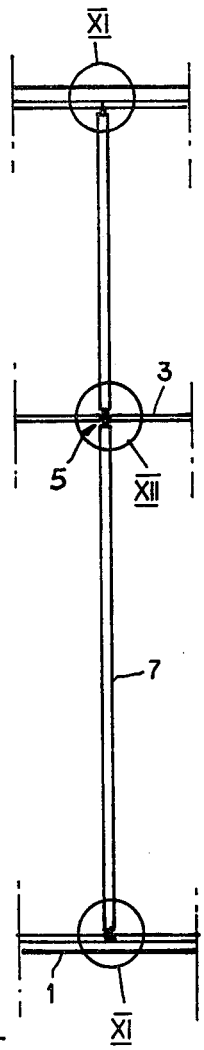
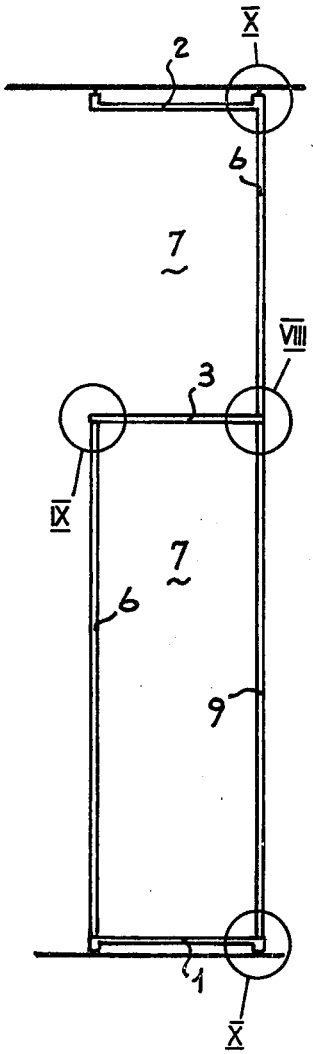
Fig. 7
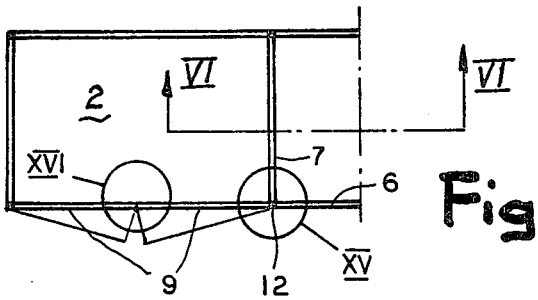
Fig. 5

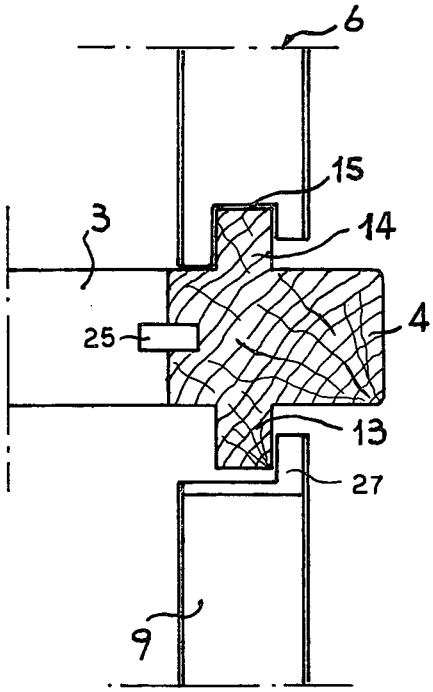
Fig. 8
Fig. 9
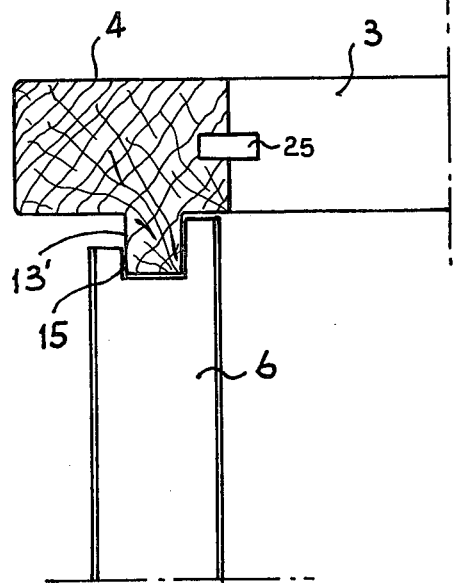
Fig. 10
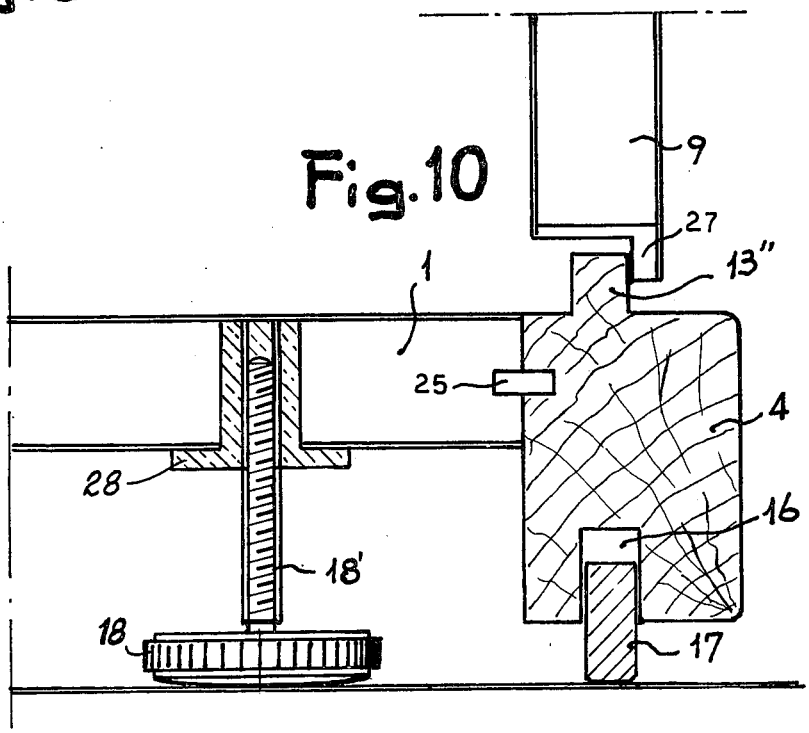

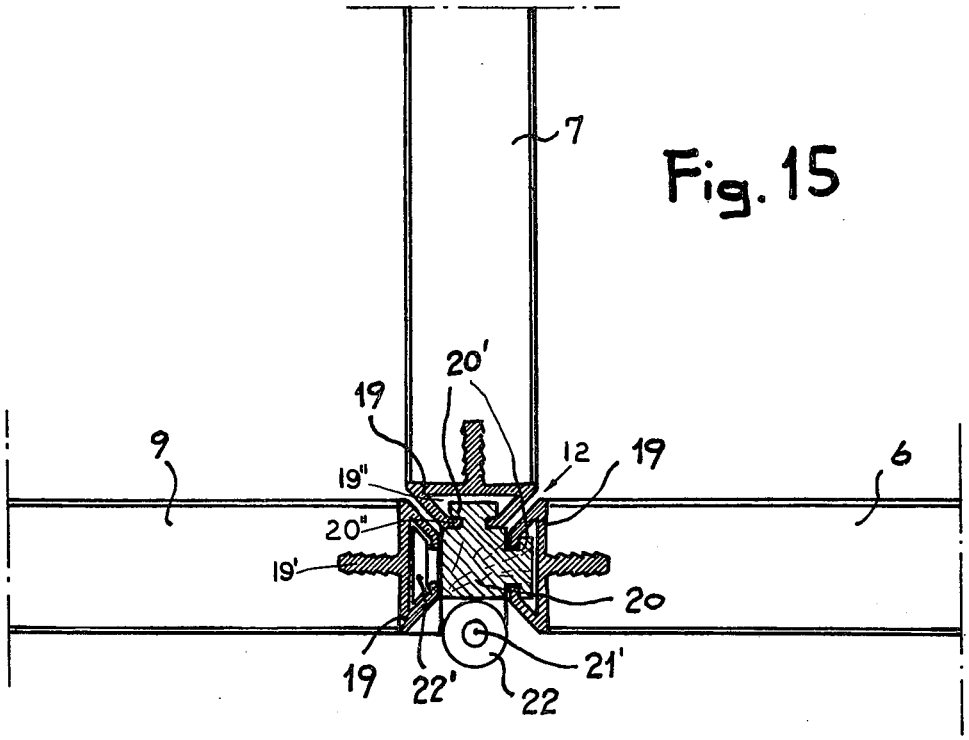
Fig. 15
Fig. 16
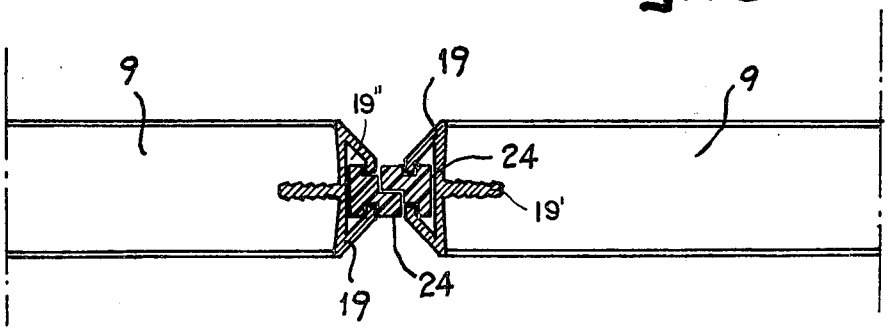

COMPOSITE MODULAR FURNITURE

FIELD OF THE INVENTION

My present invention relates to a modular piece of furniture which is subdivided into a number of compartments serving as storage spaces, with or without swinging doors or sliding panels.

BACKGROUND OF THE INVENTION

Such pieces of furniture are frequently used as room dividers and, in that case, must have at least one door through which a person may pass from one side to the other. It is also generally desirable to provide them with open shelves for books or decorative articles and with cabinets closable by doors or panels with or without glass panes. Room dividers of this type, extending in two or three dimensions, are widely used in homes, offices, schools, stores, hotels, libraries and the like. In many of these instances the number and distribution of these distinct kinds of compartments should be variable according to changing requirements. Thus, it is customary to assemble such furniture pieces from modular units which can be utilized in different combinations.

The usual way of connecting such modular units to one another, and to a fixed skeletal framework, is with the aid of bolts and nuts which are not only unsightly but also laborious to emplace and remove.

OBJECT OF THE INVENTION

The object of my present invention, acccordingly, is to provide a piece of furniture of the type referred to which can be easily assembled, disassembled, and reassembled in modified form without the use of hardware such as nuts and bolts.

SUMMARY OF THE INVENTION

I realize this object, in conformity with my present invention, by providing a set of horizontal moldings—preferably of wood—disposed at respective junctions of orthogonally adjoining vertical and horizontal wall members, the moldings and the adjoining wall-member edges being provided with interfitting formations whereby the wall members are releasably interconnected.

The interfitting formations may include longitudinal ribs on the moldings and longitudinal grooves on the edges of the corresponding wall members. Such a rib can also serve as an abutment for a horizontal edge of a cabinet door when the latter is swung from an open to a closed position.

According to a further feature of my invention, a swinging door leaf is pivotally mounted on a supporting wall member with the aid of two upright profiles, e.g. of metal or synthetic resin, respectively secured to a vertical edge of that supporting member and to an adjoining edge of the door leaf, the two profiles being provided with interengaging hinge elements. Advantageously, the profiles are hollow and have a generally trapezoidal cross-section with outwardly converging flanks separated by a slot traversed by an extension of a hinge element or of a carrier therefor inserted into the profile. The hinge carrier may be a bar provided with several vertically spaced apertures for the selective positioning of the associated hinge elements thereon.

BRIEF DESCRIPTION OF THE DRAWING

The above and other features of my invention will now be described in detail with reference to the accompanying drawing in which:

FIG. 4 is a fragmentary schematic front-elevational view of a section of the room divider shown in FIGS. 1–3;

FIG. 5 is a top view of the divider section seen in FIG. 4;

FIG. 6 is a cross-sectional view taken on the line VI—VI of FIG. 5;

FIG. 7 is a cross-sectional view taken on the line VII—VII of FIG. 4;

FIGS. 8–10 are detail views of wall-member junctions marked by respective circles VIII, IX and X in FIG. 7;

FIGS. 15 and 16 are detail views of wall-member junctions marked by respective circles XV and XVI in FIG. 5.

SPECIFIC DESCRIPTION

Figure 1:
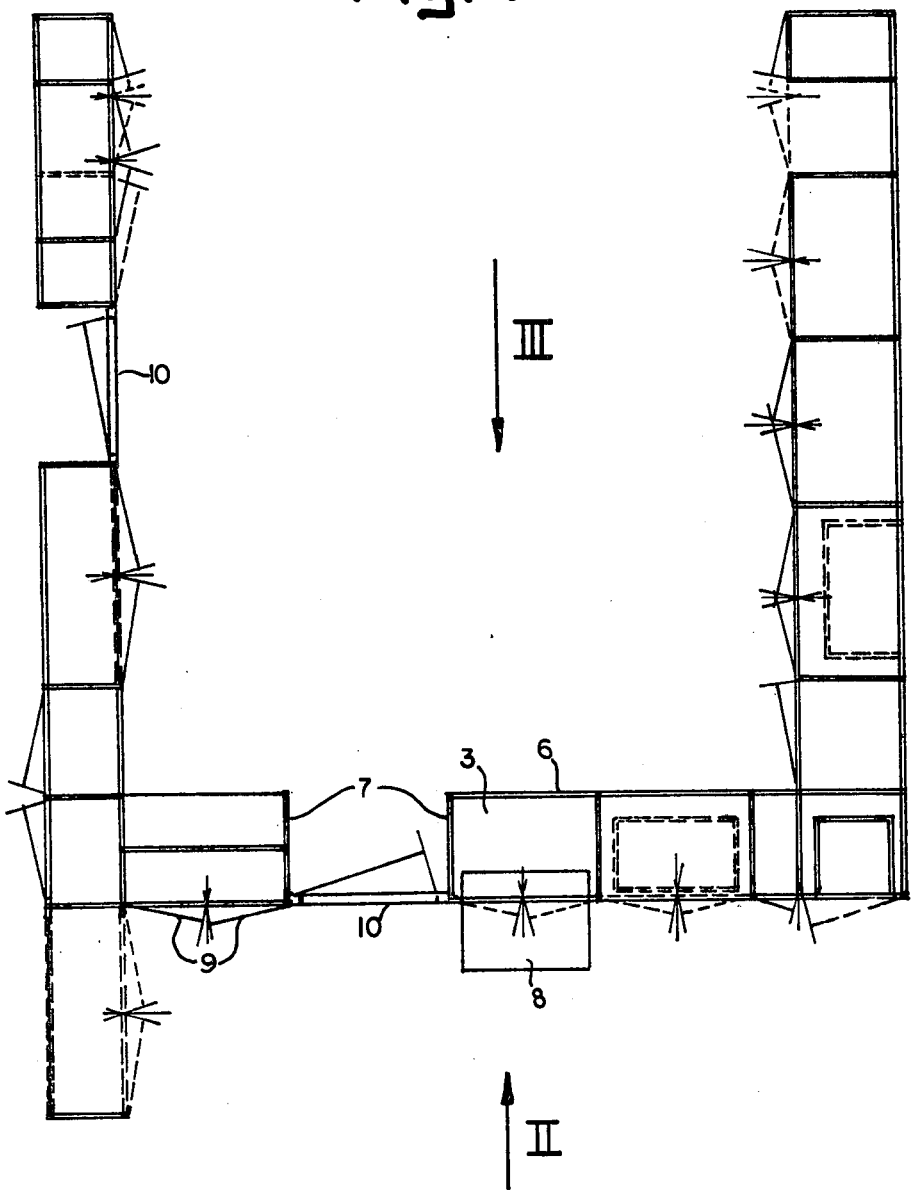
FIG. 1 is a diagrammatic plan view of a three-dimensional room divider embodying my invention.
Figure 2:
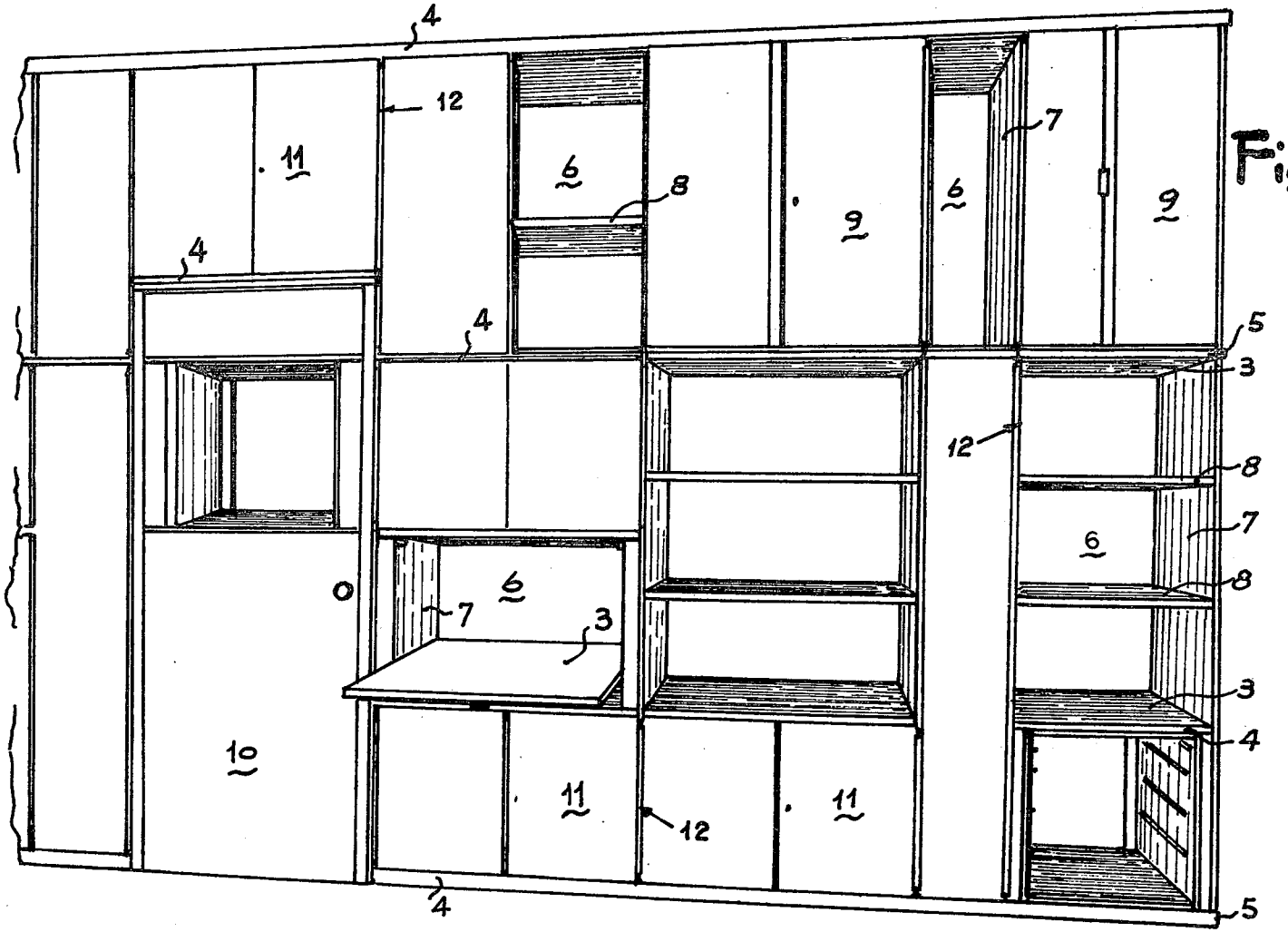
FIGS. 2 and 3 are perspective views of the divider as seen in the directions II and III, respectively, of FIG. 1.
Figure 3:
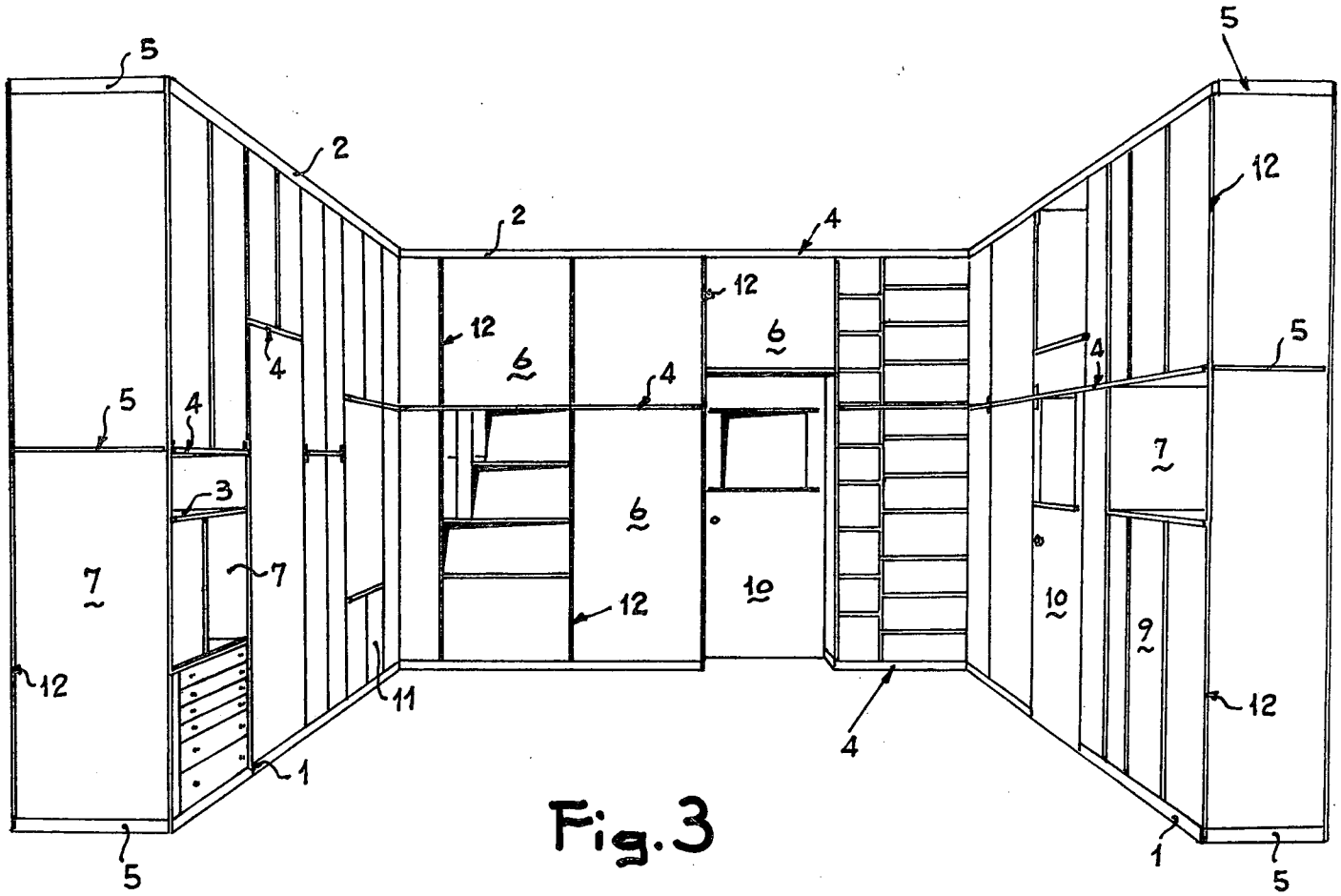
Figure 11:
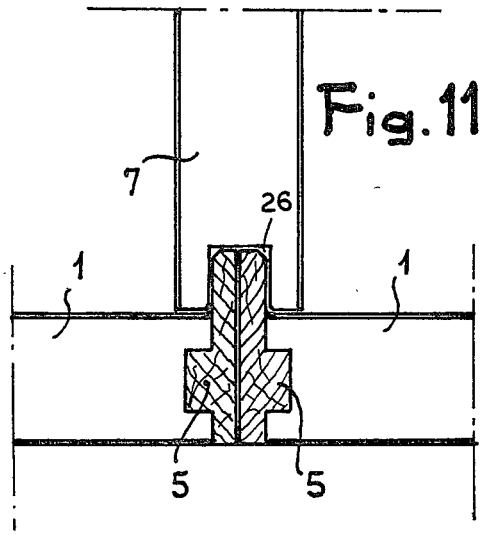
FIGS. 11 and 12 are detail views of wall-member junctions marked by respective circles XI and XII in FIG. 6.

In FIGS. 1–3 I have shown a piece of furniture, designed as a three-dimensional room divider, consisting of two lateral sections and one transverse central section. Each section has a skeletal framework comprising a pair of horizontal end boards, i.e. a bottom board 1 resting on the floor of the room and a top board 2 close to its ceiling, as well as a number of fixed vertical wall members 6 and 7 parallel and perpendicular to the major faces of the section. Transverse uprights 7 constitute the ends of each section and also intermediate partitions defining a multiplicity of compartments and door frames, together with intermediate horizontal wall members or boards 3. Two of the sections are shown to have man-size doors 10. Some of the compartments are subdivided by withdrawable shelves 8 while others are closable toward the outside by swinging doors 9 or sliding panels 11.

Fixedly positioned main wall members 6 and 7, extending at right angles to each other, are interconnected along adjacent vertical edges by joints generally designated 12 in FIGS. 2 and 3, these joints being more fully described hereinafter with reference to FIG. 15. Bottom, top and intermediate horizontal boards 1, 2 and 3 are secured to these main wall members 6 and 7 with the aid of respective moldings 4 and 5 extending along adjoining horizontal edges, parallel and perpendicular to the major sectional faces, as schematically indicated in FIGS. 4–7 and more fully illustrated in FIGS. 8–14.

As shown in FIG. 8, a molding 4 (seen in cross-section) has a pair of opposite, vertically projecting longitudinal ribs 13 and 14, the lower rib 13 serving as an abutment for a door leaf 9 provided with a flange 27 which in the closure position of the leaf comes to rest against the rib. Upper rib 14 fits into a mating groove 15 of a wall member 6 in line with the closed door leaf. Molding 4 rests against a longitudinal edge of an intermediate horizontal wall member 3 to which it is fastened by a number of dowels 25 (only one shown); it will be apparent that the connection between wall member 3 and molding 4 could also be constituted by a pair of mating formations such as rib 14 and groove 15, as shown for moldings 5 in FIGS. 12 and 14.

FIG. 9 shows a similar molding 4 with a single depending rib 13' received with a loose fit in a groove 15 of a wall member 6, molding 4 being again connected by dowels 25 to a wall member 3 which in this instance, however, serves as a fixed shelf accessible from the front, i.e. from the left as viewed in this Figure. Molding 4 of FIG. 9, therefore, lacks the upstanding rib 14 of FIG. 8.

The molding 4 shown in FIG. 10 is fastened to the bottom board 1 of its room-divider section and has an upstanding rib 13" serving as an abutment for a flange 27 of an overlying door leaf 9. The underside of the molding is formed with a longitudinal groove 16 slidably accommodating a strip 17 which rests on the floor and conceals a number of adjustable bosses or feet 18 in the form of knobs with threaded stems 18' screwed into nuts 28 on board 1. A similar but relatively inverted assembly can be provided at a top board 2 (cf. FIG. 3) braced by adjustable bosses 18 against the ceiling; in that instance the masking strip 17 may be biased upwardly by springs seated in groove 16. Obviously, gaps between the room divider and other wall surfaces can be closed in like manner.

In FIGS. 11–14 I have illustrated various ways of joining vertical wall members 7 to horizontal wall members 1 or 3 with the aid of moldings 5; again, analogous arrangements can be provided for an upper wall member or top board 2. According to FIG. 11, a T-joint between two bottom boards 1 and an upright 7 is formed by two moldings 5 positioned back-to-back between the bottom boards and provided with longitudinal ribs tightly fitted into complementary grooves of the latter. The upper edges of the two moldings 5 are received with a somewhat looser fit in a longitudinal groove 26 of wall member 7.

Figure 12:
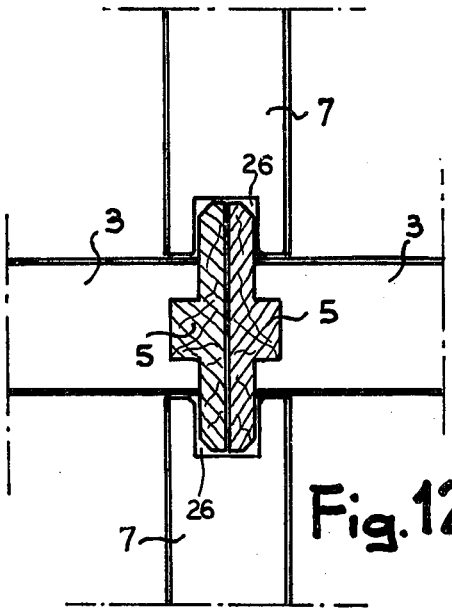

In FIG. 12 the two contacting moldings 5 are rigid with intermediate horizontal wall members 3 and are downwardly extended to enter a groove 26 of a second upright 7 disposed below the joint.

Figure 13:
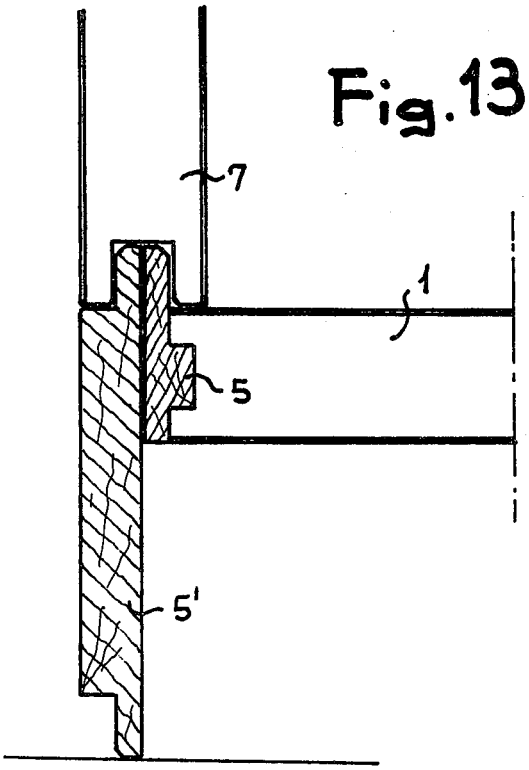

FIG. 13 shows an exposed lower edge at the junction of a bottom board 1 with an upright 7. The left-hand molding 5 of the preceding two Figures is here replaced by a modified molding 5' of increased height serving as a supporting foot for the structure or as a cover strip similar to strip 17 in FIG. 10.

Figure 14:
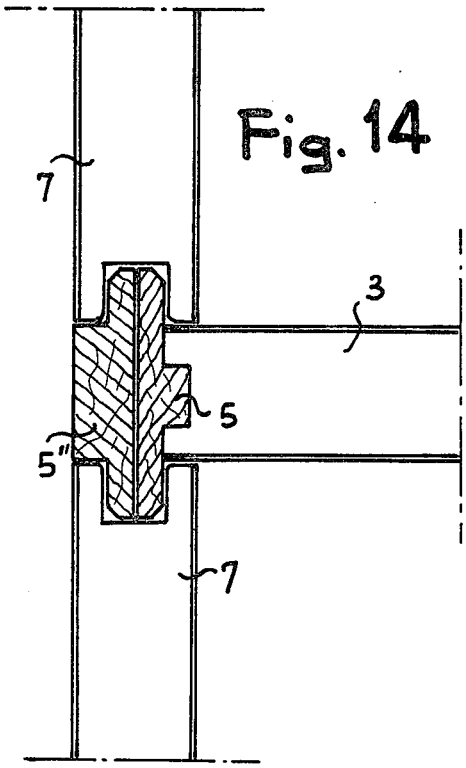
FIGS. 13 and 14 are detail views of wall-member junctions marked by respective circles XIII and XIV in FIG. 4.

The joint of FIG. 14 also lies at an exposed surface of the room divider, but at an intermediate level. It differs from the joint of FIG. 12 in that a modified molding 5" has a rib of the same height as wall member 3 and is flush with uprights 7 to fill the gap between them.

FIG. 15 illustrates in detail a vertical joint 12 formed between three uprights, i.e. two stationary walls 6, 7 and a door leaf 9. The joint comprises a plurality of hollow profiles 19 fixedly secured to the mutually adjacent vertical edges of the three wall members, these profiles consisting preferably of metal though hard plastics could also be used. Each profile is integral with a corrugated back fin 19' slid vertically into a mating groove of the associated wall member, the sawtooth-shaped corrugations of the fin surface and the groove wall preventing any separation of the profile from that wall member. The profiles 9 are of trapezoidal configuration, with outwardly converging flanks lying substantially along diagonals of an imaginary square and with inbent lips defining dovetail-shaped spaces 19". A wooden bar 20 of square cross-section, concentric with the aforementioned imaginary square, occupies the clearance existing between these profiles and has a pair of integral extensions or tenons 20' inserted into the spaces 19" of the two profiles 19 rigid with the stationary wall members 6 and 7. The tenons 20' have lateral grooves 20" receiving the inbent lips of the associated profile flanks.

Figure 19:
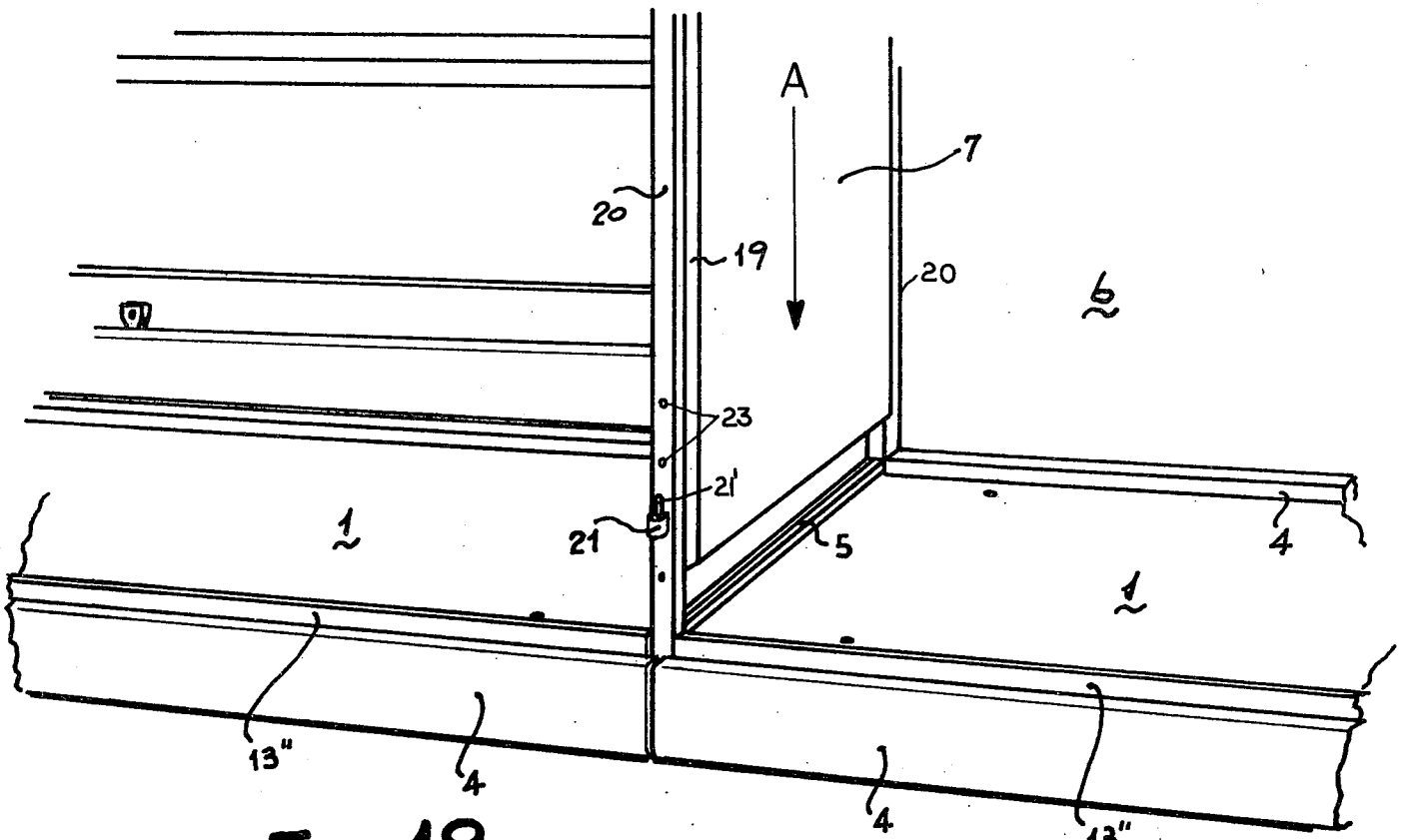

FIG. 19, illustrating the sliding of wall member 7 into engagement of its profiles 19 with respective supporting bars 20, shows vertically spaced holes 23 provided on these bars to form seats for stationary hinge elements 21 coacting with movable hinge elements 22 (FIG. 15) which are penetrated by pintles 21' of elements 21. Hinge elements 22 have bases 22' matingly received in the space 19" of the profile 19 which lines the adjoining edge of door leaf 9. That door leaf, accordingly, is swingably connected with wall members 6 and 7 at the joint 12.

As shown in FIG. 16, confronting edges of two swinging door leaves 9 are provided with similar profiles 19 whose internal spaces 19" are partly occupied by bumper strips 24 of rubber or the like overlapping each other in the closure position to form a dustproof seal therebetween.

Figure 17:
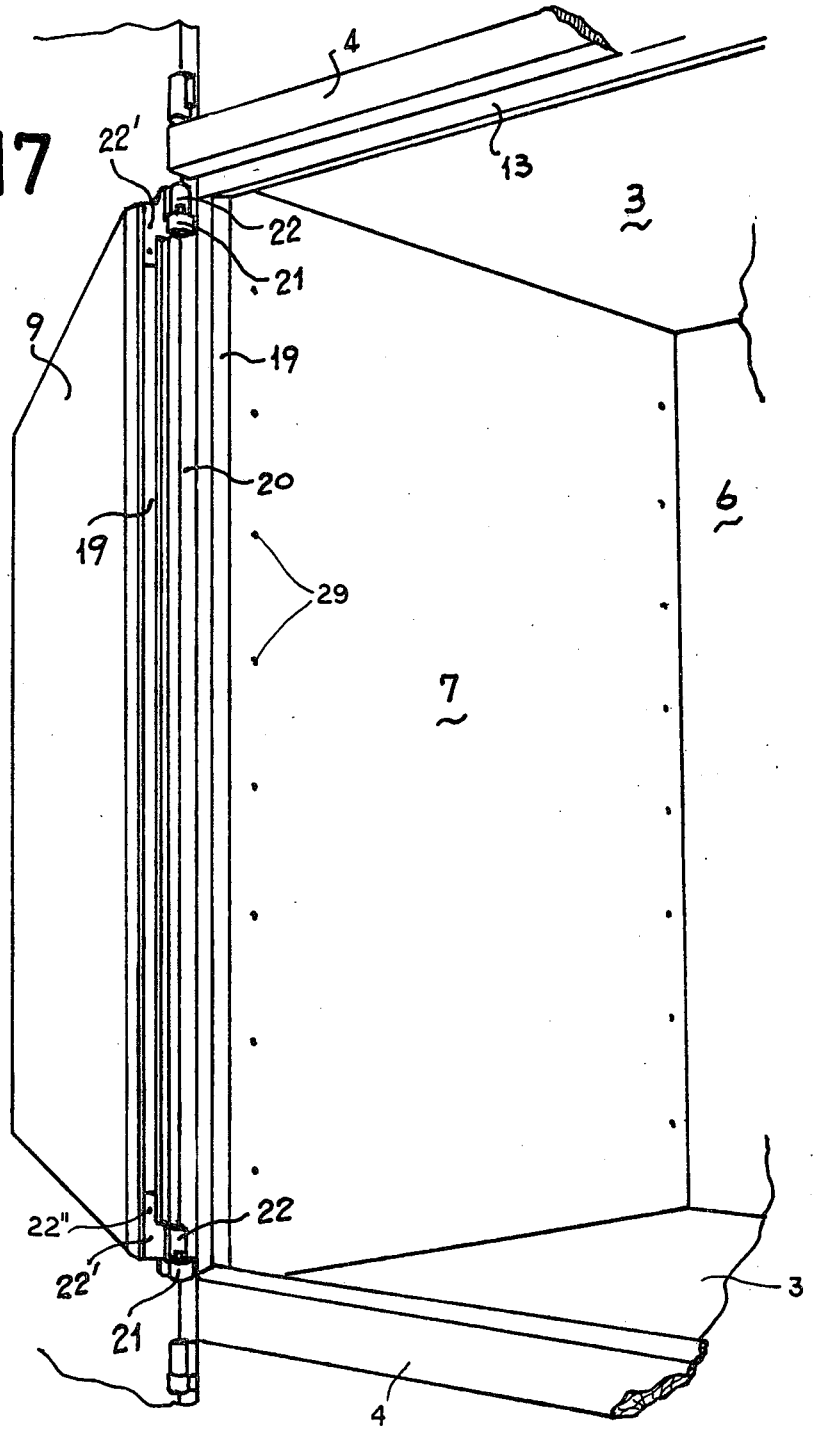
FIGS. 17–19 are perspective detail views of further wall-member junctions.

FIG. 17 is a perspective view of a joint such as the one shown in FIG. 15 between wall members 3 and 7, with a door leaf 9 swung out into an open position. Hinge bases 22' may be fastened to the associated profile 19 on door leaf 9 by screws 22". Bar 20 is shown recessed at its upper and lower ends in order to provide room for the connection between hinge elements 22 and their bases 22'. As also seen in FIG. 17, partitions 7 may be provided with mounting holes 29 for the attachment of shelf-supporting ledges.

Figure 18:
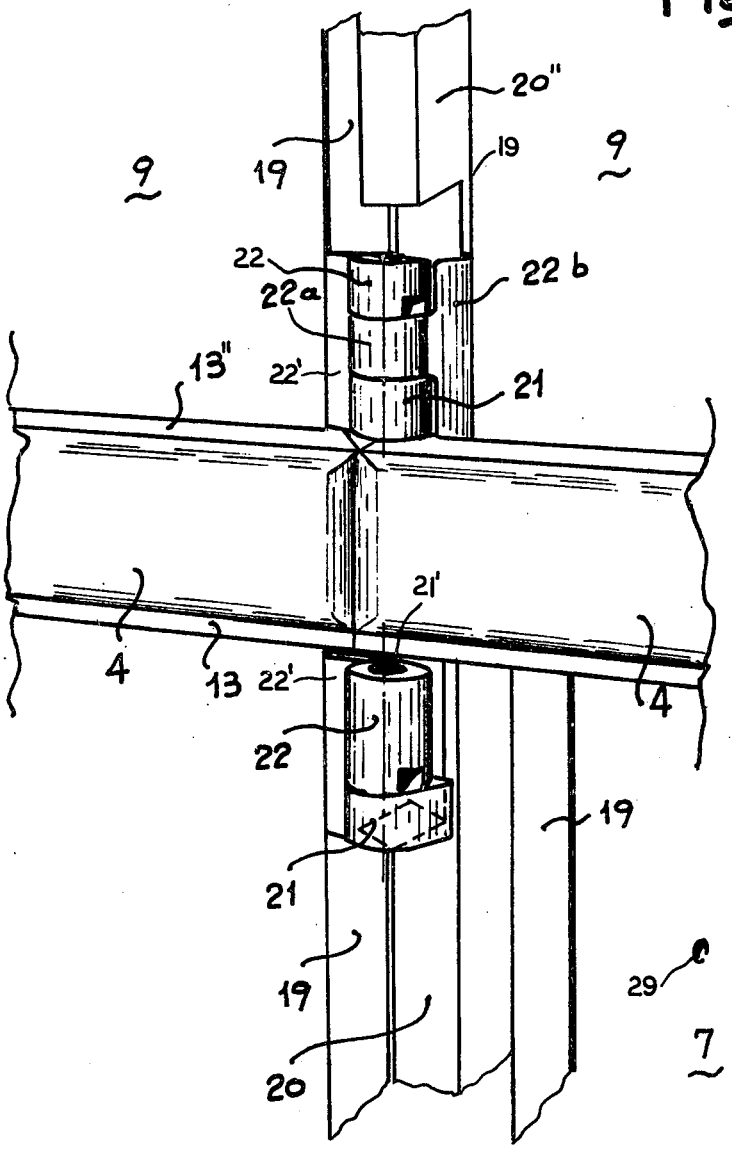

FIG. 18 illustrates a hinge 21, 22 of the type described with reference to FIGS. 15 and 17, disposed below a pair of adjoining moldings 4 with abutment ribs 13 and 13", and a modified three-element hinge above these moldings serving to secure two independently swingable door leaves 9 to a partition 7. This upper hinge comprises elements 21 and 22 secured in the aforedescribed manner to a recessed bar 20 and to a profile 19 on the left-hand door leaf 9, a further hinge element **22*a* being similarly attached by a base 22*b* to another such profile 19 secured to the right-hand door leaf 9. These two profiles 19 could also be made integral with their respective hinge elements 22 and 22*a*; similarly, hinge element 21 could be permanently mounted on bar 20**.

FIG. 19 further shows that bars 20 may be initially interfitted with joint-forming moldings 4 and 5 so as to serve as a fixed guide frame for a partition 7 to be slid into place (arrow A) by the engagement of its profiles 19 with these bars, the latter then extending beyond the profiles in the assembled position. Moldings 4 and 5 are here shown to line the edges of a pair of bottom boards 1.

In principle, the moldings 4 and 5 could also be mounted on their supporting wall members with the aid of ribs projecting from the edges of these wall members into mating grooves on the moldings. The illustrated arrangement, however, is more compact since it permits the use of relatively thin moldings.

I claim:

1. In a modular piece of furniture, in combination:

a first and a second upright wall member with vertical edges angularly adjoining each other;

a first and a second hollow upright profile respectively secured to said vertical edges of said first and second wall members, each of said profiles having a generally trapezoidal cross-section with outwardly converging flanks separated by a slot;

a vertical bar alongside said first profile having a tenon received in the slot thereof;

a first hinge element secured to said bar; and a second hinge element pivotally connected with said first hinge element, said second hinge element having a base received in the slot of said second profile whereby said wall members are relatively swingable about the pivotal axis of said hinge elements.

2. The combination defined in claim 1 wherein said first wall member is stationary, further comprising a stationary third upright wall member perpendicular to said first wall, and a third hollow upright profile substantially identical with said first and second profiles secured to a vertical edge of said third wall member adjacent said first profile, said bar having another tenon received in the slot of said third profile.

3. The combination defined in claim 1 wherein said bar extends endwise into engagement with a molding fitted onto an adjacent horizontal wall member.

4. The combination defined in claim 1 wherein said bar is provided with a plurality of vertically spaced apertures enabling selective positioning of said first hinge element thereon.

5. The combination defined in claim 1 wherein each profile is provided with a serrated back fin slidingly received in a complementarily shaped longitudinal groove of said vertical edge of the respective wall member.

6. The combination defined in claim 2 wherein said vertical edges define three sides of a space of square cross-section in a position of alignment of said second and third wall members, the flanks of said profiles extending substantially along the diagonals of said square cross-section.

* * * * *